US008651695B2

(12) United States Patent
Fields et al.

(10) Patent No.: US 8,651,695 B2
(45) Date of Patent: Feb. 18, 2014

(54) LED BASED HIGH-INTENSITY LIGHT WITH SECONDARY DIFFUSER

(75) Inventors: Craig Fields, Chicago, IL (US); Ken Kochman, Arlington Heights, IL (US); Kevin Brennan, Vila Park, IL (US); Tom Papanek, Lake Forest, IL (US)

(73) Assignee: Excelitas Technologies Corp., Waltham, MA (US)

( * ) Notice: Subject to any disclaimer, the term of this patent is extended or adjusted under 35 U.S.C. 154(b) by 430 days.

(21) Appl. No.: 13/053,649

(22) Filed: Mar. 22, 2011

(65) Prior Publication Data

US 2011/0235322 A1 Sep. 29, 2011

Related U.S. Application Data

(60) Provisional application No. 61/318,007, filed on Mar. 26, 2010.

(51) Int. Cl.
*F21V 7/00* (2006.01)
*F21V 5/00* (2006.01)

(52) U.S. Cl.
USPC ..... 362/246; 362/145; 362/237; 362/249.02

(58) Field of Classification Search
USPC ..... 362/145, 230, 237, 245, 246, 249.02
See application file for complete search history.

(56) References Cited

U.S. PATENT DOCUMENTS

| | | | | |
|---|---|---|---|---|
| 1,419,485 | A | 6/1922 | Arcaro et al. | |
| 2,340,515 | A | 3/1941 | Dietrich | 240/41.35 |
| 4,929,866 | A | 5/1990 | Murata et al. | 313/500 |
| 4,964,025 | A | 10/1990 | Smith | 362/346 |
| 5,130,761 | A | 7/1992 | Tanaka | 357/17 |
| 5,136,483 | A | 8/1992 | Schoniger et al. | 362/61 |
| 5,471,371 | A | 11/1995 | Koppolu et al. | 362/32 |
| 5,594,433 | A | 1/1997 | Terlep | 340/908.1 |
| 5,833,355 | A | 11/1998 | You et al. | 362/244 |
| 5,929,788 | A | 7/1999 | Vukosic | 340/908.1 |
| 6,183,100 | B1 | 2/2001 | Suckow et al. | 362/35 |

(Continued)

FOREIGN PATENT DOCUMENTS

| | | |
|---|---|---|
| CA | 2541686 | 4/2005 |
| EP | 1731423 | 6/2006 |

(Continued)

OTHER PUBLICATIONS

PCT International Search Report for International Application No. PCT/US2010/033123 dated Jul. 19, 2010 (4 pages).

(Continued)

*Primary Examiner* — David V Bruce
(74) *Attorney, Agent, or Firm* — Peter A. Nieves; Sheehan Phinney Bass + Green PA

(57) ABSTRACT

A high intensity LED based lighting array for use in an obstruction light with efficient uniform light output is disclosed. The high intensity LED based lighting array has a ring assembly having a plurality of reflectors and light emitting diodes. The ring assembly has a planar surface mounting each of the plurality of primary reflectors in perpendicular relation to a respective one of the plurality of light emitting diodes. A secondary diffuser is positioned on the ring to mix light from the light emitting diodes to create a uniform light emission in a range of azimuth angles.

20 Claims, 8 Drawing Sheets

(56) References Cited

U.S. PATENT DOCUMENTS

| | | | | |
|---|---|---|---|---|
| 6,364,506 | B1 | 4/2002 | Gallo | 362/245 |
| 6,464,373 | B1 | 10/2002 | Petrick | 362/235 |
| 6,481,872 | B1 | 11/2002 | Hayashi et al. | 362/297 |
| 6,679,621 | B2 | 1/2004 | West et al. | 362/327 |
| 6,932,496 | B2 | 8/2005 | Rizkin et al. | 362/299 |
| 7,160,004 | B2 | 1/2007 | Peck | 362/341 |
| 7,568,821 | B2 | 8/2009 | Peck et al. | |
| 2002/0085374 | A1 | 7/2002 | Anderson | 362/147 |
| 2004/0218391 | A1 | 11/2004 | Procter | |
| 2005/0110649 | A1 | 5/2005 | Fredericks et al. | 340/815.45 |
| 2006/0007012 | A1 | 1/2006 | Machi et al. | 340/815.45 |
| 2006/0291209 | A1 | 12/2006 | Booth et al. | 362/247 |
| 2007/0081331 | A1 | 4/2007 | Wang | 362/249.05 |
| 2010/0027281 | A1 | 2/2010 | Waters et al. | |
| 2010/0220478 | A1* | 9/2010 | Fields et al. | 362/237 |
| 2011/0235322 | A1 | 9/2011 | Fields et al. | 362/230 |

FOREIGN PATENT DOCUMENTS

| | | |
|---|---|---|
| EP | 2090820 | 2/2009 |
| EP | 1698823 | 4/2010 |
| GB | 2350176 | 5/1999 |
| WO | WO 9519525 | 7/1995 |
| WO | WO 0249917 | 6/2002 |
| WO | WO 2004070266 | 8/2004 |

OTHER PUBLICATIONS

PCT Written Opinion for International Application No. PCT/US2010/033123 dated Jul. 19, 2010 (8 pages).

European Search Report for International Application No. 09152762.2 dated Jul. 14, 2010 (8 pages).

* cited by examiner

LED BASED HIGH-INTENSITY LIGHT WITH SECONDARY DIFFUSER

RELATED APPLICATIONS

This application claims priority to U.S. Provisional Application No. 61/318,007 filed Mar. 26, 2010. That application is related to U.S. Provisional Application No. 60/174,785 filed on May 1, 2009. That application claims priority from U.S. application Ser. No. 12/370,793 filed on Feb. 13, 2009 which in turn claims priority to U.S. Provisional Application No. 61/065,845 filed on Feb. 15, 2008, all of which are hereby incorporated by reference in their entirety.

TECHNICAL FIELD

The present disclosure relates to high intensity lights, and more specifically to an LED-based high intensity obstruction light with a secondary diffuser to smooth light output.

BACKGROUND

High intensity lights are needed for applications such as navigation beacons. For example, navigation lamps must be capable of meeting the 20,000 cd requirements for the FAA (US Federal Aviation Authority which sets requirements for airfield and obstruction lighting in the United States and North America) L865-L864 standard and the ICAO (International Civil Aviation Organization which sets requirements for airfield and obstruction lighting for Europe and most international regions outside North America) Medium Intensity Navigation Lights. In the past, lamps have used conventional strobe lights. However, such lights are energy and maintenance intensive. Recently, lamps have been fabricated using light emitting diodes (LEDs). LEDs create unique requirements in order to be commercially viable in terms of size, weight, price, and cost of ownership compared to conventional strobe lights.

Requirements for high intensity lights used for airfield and obstruction lighting are expressed in azimuth, elevation, horizon intensity and radials among other terms. Azimuth is an angular measurement in spherical coordinates measured in degrees. Azimuth angles are perpendicular to a center axis measured in the horizon plane. Generally, airfield and obstruction lighting are omni-directional, meaning they emit light over 360° of azimuth. Elevation is an angular measurement in spherical coordinates measured in degrees. Elevation angles are measured plus and minus from horizon. Positive elevation angles are angles above horizon, and negative elevation angles are angles below horizon. The horizon is a plane at an elevation angle of 0° which is parallel to the earth and perpendicular to the force of gravity. The location of the horizon plane is at the center of a light engine. Intensity or beam intensity is the luminous power emitted by a source in a particular direction, expressed in Candela, abbreviated as (cd). Radial is a plane slice taken perpendicular to any azimuth angle and is typically used to describe beam intensity at various elevation angles. Photometric specifications require beam intensities to be within defined parameters for every radial over 360° of azimuth.

The FAA and ICAO regulations set stringent requirements for beam characteristics at all angles of rotation (azimuth) for a light engine. For the ICAO standard, lights must have effective (time-averaged) intensity greater than 7500 candela (cd) over a 3° range of tilt (elevation). Lights must also have peak effective intensity of greater than 15,000 at the horizon and peak effective intensity no greater than 25,000 cd at all angles of elevation. An effective intensity at −10° elevation must be no greater than 3% of peak intensity at that azimuth radial. Also a very narrow "window" of effective intensity of 7,500-11,250 cd at −1° of elevation for all angles of rotation must be met.

Similar standards must be met for an ICAO compliant 2,000 cd beacon. For this beacon, ICAO regulations set the stringent requirements for beam characteristics at all angles of rotation. The effective (time-averaged) intensity must be greater than 750 cd over a 3° range of elevation. The peak effective intensity must be greater than 1,500 cd at 0° elevation and no greater than 2,500 cd at all angles of elevation. A very narrow "window" of effective intensity (750-1,125 cd) at −1° of elevation for all angles of azimuth must be met.

It is desirable that light devices meeting ICAO requirements for 20,000 cd lights also meet the requirements of the FAA specifications for L865 and L864 Medium Intensity Obstruction Lights. Such lights must have effective (time-averaged) intensity greater than 7,500 cd over a 3° range of elevation. The peak effective intensity must be greater than 15,000 cd at 0° elevation and no greater than 25,000 cd at all angles of elevation.

Other countries have different, but still stringent, requirements for high intensity obstruction lights. For example, Germany has a 170 cd minimum red obstruction specification which must comply with "Bundesminesterium für Verkehr, Bau-und Wohnungswesen" and as specified in "Nachricthen für Luftfahrer" general administrative regulation for marking and lighting obstacles to air navigation specific to Annex 3: "Specifications for W red lights."

Similarly, the United Kingdom has a specification for a 2,000 cd red obstruction light. The United Kingdom specification is per "CAP 393 Air Navigation: Order and the Regulations" for lighting of wind turbine generators in UK territorial waters. This specification includes requirements that the angle of the plane of the beam of peak intensity emitted by the light must be elevated 3-4° above the horizontal plane and not more than 45% or less than 20% of the minimum peak intensity must be visible at the horizontal plane. Further, not more than 10% of the minimum peak intensity must be visible at 1.5° or more below the horizontal plane.

In order to achieve the total light intensity required for a light using LEDs compliant with FAA, ICAO and other standards, it is necessary to use a large number of LED light sources. However, it is difficult to create a beam with the desired intensity pattern when directing large numbers of LED sources into few reflectors. Furthermore, smaller and therefore more numerous reflectors are needed to conform to overall size restrictions. These constraints all result in a design with a large number of optical elements comprised of individual LEDs and small reflectors. A final challenge is that even at any one angle of azimuth, it is difficult to achieve an elevation beam pattern which simultaneously satisfies the ICAO requirements for peak (maximum) intensity and also falls within the minimum and maximum intensity "window" at −1°. It is also difficult to achieve the same elevation beam pattern at all angles of azimuth. Since the elevation beam patterns must fall within the required limits at all angles of azimuth, this further compounds the difficulty of meeting the full specifications of the FAA, ICAO and other organizations.

Thus an efficient LED-based based light that meets FAA, ICAO and other standards is desirable. An LED based light design allowing the use of relatively small reflectors and may be scaled to meet different standards is also desirable. An LED based light design that reliably provides uniform light beam output over all angles of azimuth in compliance with such standards also does not exist.

SUMMARY

One disclosed example relates to a light engine for a high intensity light with a first ring assembly having a first plurality of reflectors and light emitting diodes. The ring assembly has a planar surface mounting each of the plurality of reflectors in positional relation to a respective one of the plurality of light emitting diodes. A diffuser is interposed around the first concentric ring assembly to mix light from at least some of the plurality reflectors and light emitting diodes.

Another example is a high intensity light beacon designed to be compliant with FAA and ICAO standards. The light beacon includes a first ring assembly having a first plurality of primary reflectors and light emitting diodes. The ring assembly has a planar surface mounting a first diffuser positioned in relation to the first plurality of primary reflectors and light emitting diodes. The first diffuser mixes the light from the first plurality of primary reflectors and light emitting diodes. A second ring assembly is mounted on the first ring assembly and has a second plurality of primary reflectors and light emitting diodes. The second ring assembly has a planar surface mounting a second diffuser positioned in relation to the second plurality of primary reflectors and light emitting diodes. The second diffuser mixes the light from the second plurality of primary reflectors and light emitting diodes. A third ring assembly is mounted on the second ring assembly. The third ring has a third plurality of reflectors and light emitting diodes. The third ring assembly has a planar surface mounting a third diffuser positioned in relation to the third plurality of primary reflectors and light emitting diodes. The third diffuser mixes the light from the third plurality of primary reflectors and light emitting diodes. A fourth ring assembly is mounted on the third ring assembly. The fourth ring assembly has a fourth plurality of reflectors and light emitting diodes. The fourth ring assembly has a planar surface mounting a fourth diffuser positioned in relation to the fourth plurality of primary reflectors and light emitting diodes. The fourth diffuser mixes the light from the fourth plurality of primary reflectors and light emitting diodes.

Additional aspects will be apparent to those of ordinary skill in the art in view of the detailed description of various embodiments, which is made with reference to the drawings, a brief description of which is provided below.

Figure 1:
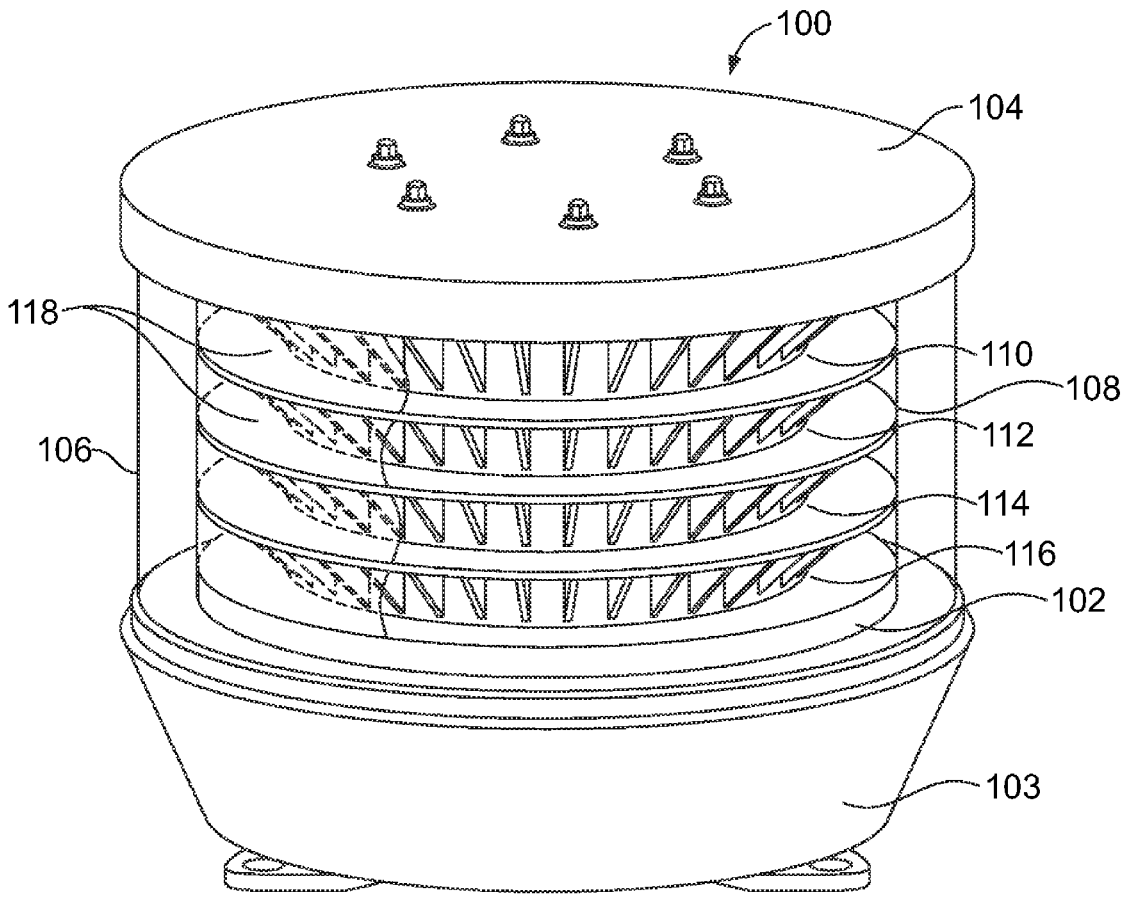
FIG. 1 is a perspective view of an example staggered LED high intensity light with exterior diffuser elements.

While these examples are susceptible of embodiment in many different forms, there is shown in the drawings and will herein be described in detail preferred examples with the understanding that the present disclosure is to be considered as an exemplification and is not intended to limit the broad aspect to the embodiments illustrated.

DETAILED DESCRIPTION

FIG. 1 shows an example high intensity LED-based light 100. The LED-based light 100 may be used as an aircraft beacon obstruction light and may be compliant with applicable FAA and ICAO standards for a 20,000 cd light engine. The light 100 may be adapted to conform to other standards. The high intensity LED-based light 100 has a base housing 103, a top housing 104, and a transparent cylindrical housing 106. The base housing 103, top housing 104, and transparent cylindrical housing 106 enclose a light engine 108. The base housing 103 and top housing 104 provide support and alignment for the light engine 108 while allowing heat to be transferred from the LEDs and power supplies in the light engine 108 to the ambient surroundings. The light engine 108 has a series of lighting ring assemblies 110, 112, 114, and 116 that will be detailed below. The base housing 103 is generally cylindrical in shape and contains wiring, power supplies, and controls for the optical elements of the stacked lighting ring assemblies 110, 112, 114 and 116.

As shown in FIG. 1, the lighting ring assemblies 110, 112, 114 and 116 are arrayed in a vertical stack with the lighting ring assembly 110 at the top of the stack and the ring assembly 116 at the bottom of the stack. The complete light engine 108 therefore consists of four vertically stacked ring assemblies 110, 112, 114 and 116 mounted to a base ring 102. Of course different numbers of ring assemblies may be used such as a single ring assembly or up to twenty-five or more assemblies for more or less powerful lights. Each of the ring assemblies 110, 112, 114 and 116 is covered by a circular diffuser element 118.

Figure 2:
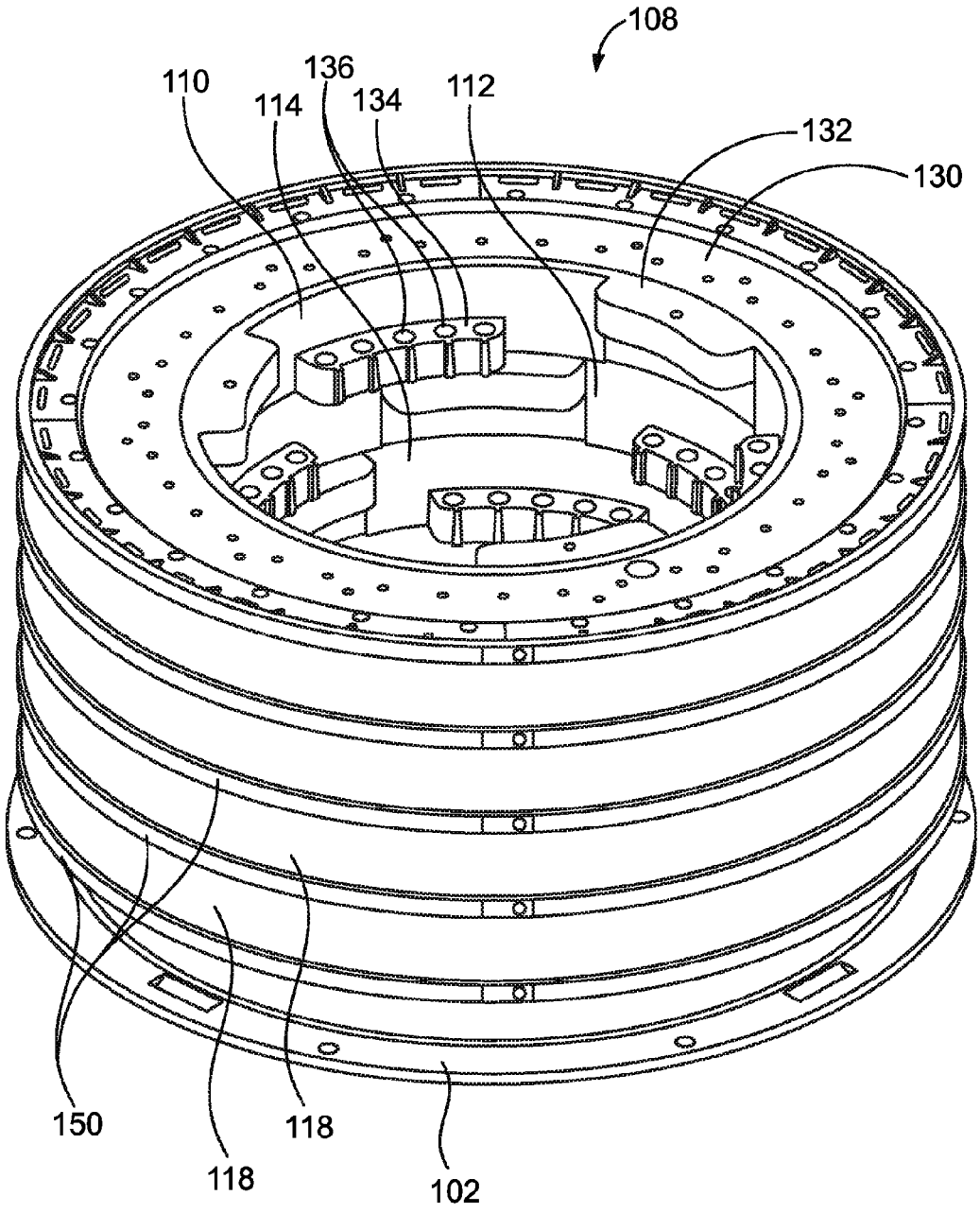
FIG. 2 is a perspective view of the concentric ring assemblies of LEDs, reflectors and diffuser elements of the LED high intensity light in FIG. 1.
Figure 3:
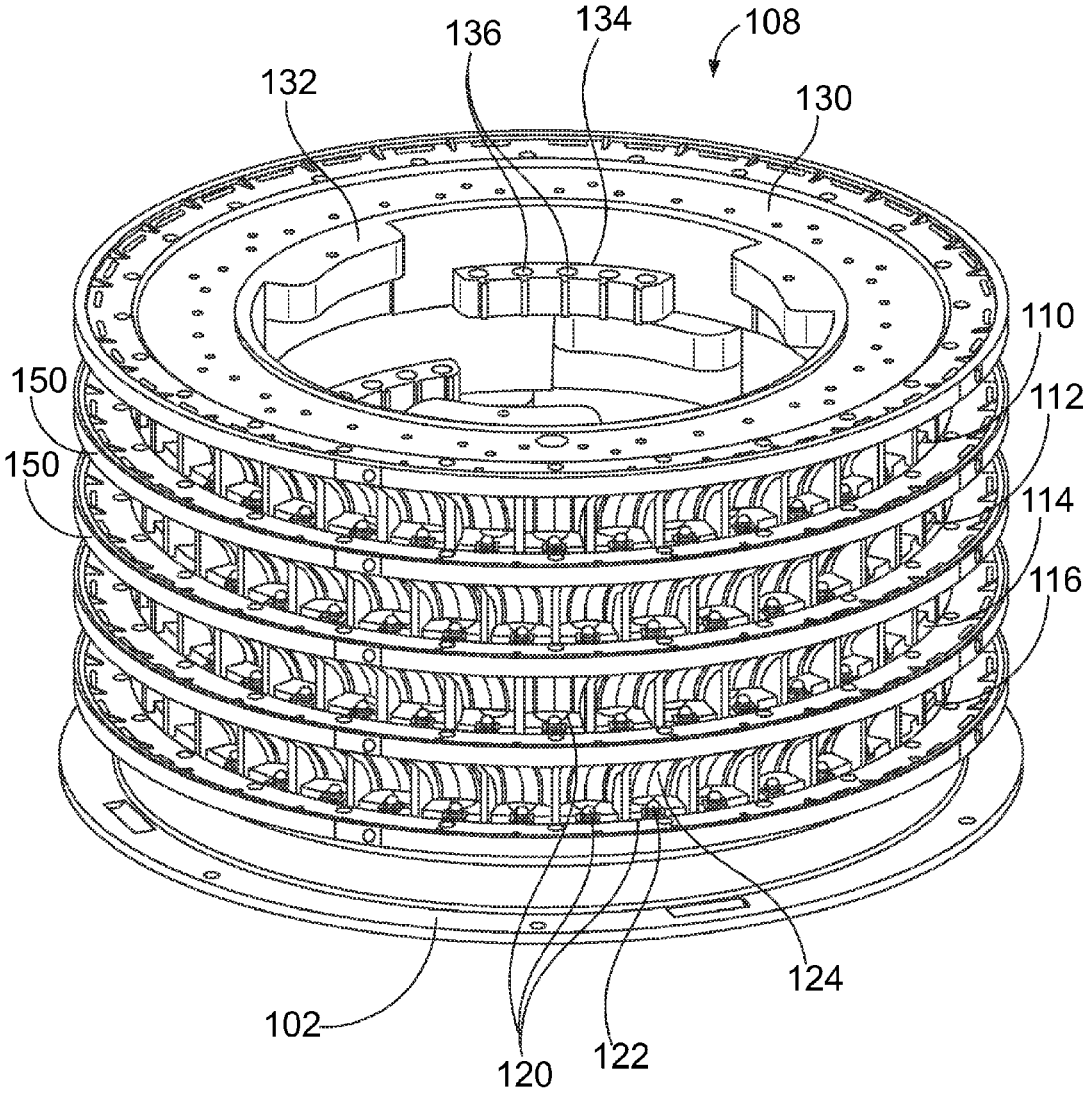
FIG. 3 is a perspective view of the concentric ring assemblies of LEDs and reflectors of the LED high intensity light in FIG. 1 without the exterior diffuser elements.
Figure 4:
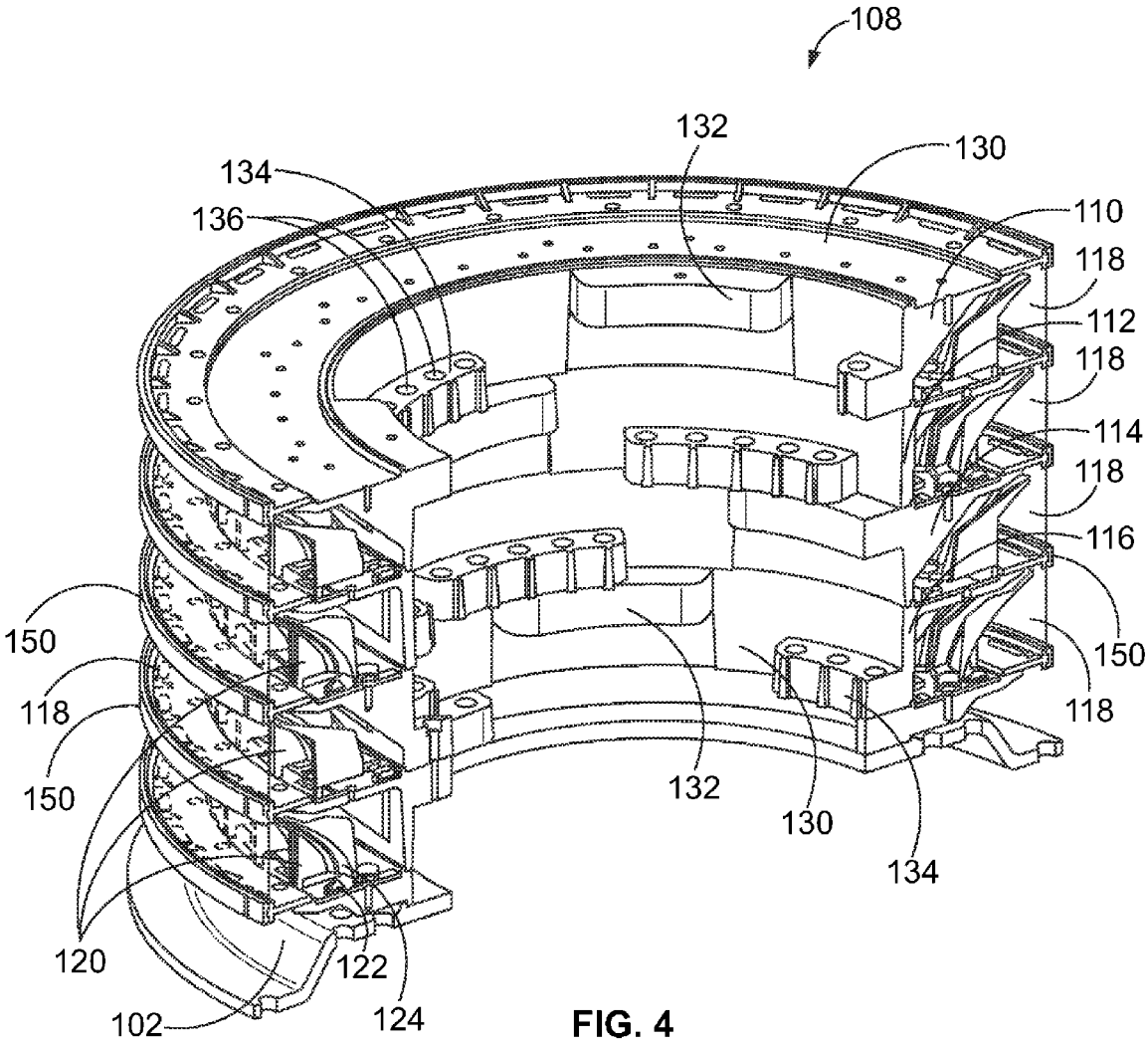
FIG. 4 is a cross-section view of the concentric ring assembles of LEDs, reflectors and diffuser elements of the LED high intensity light in FIG. 1.
Figure 5:
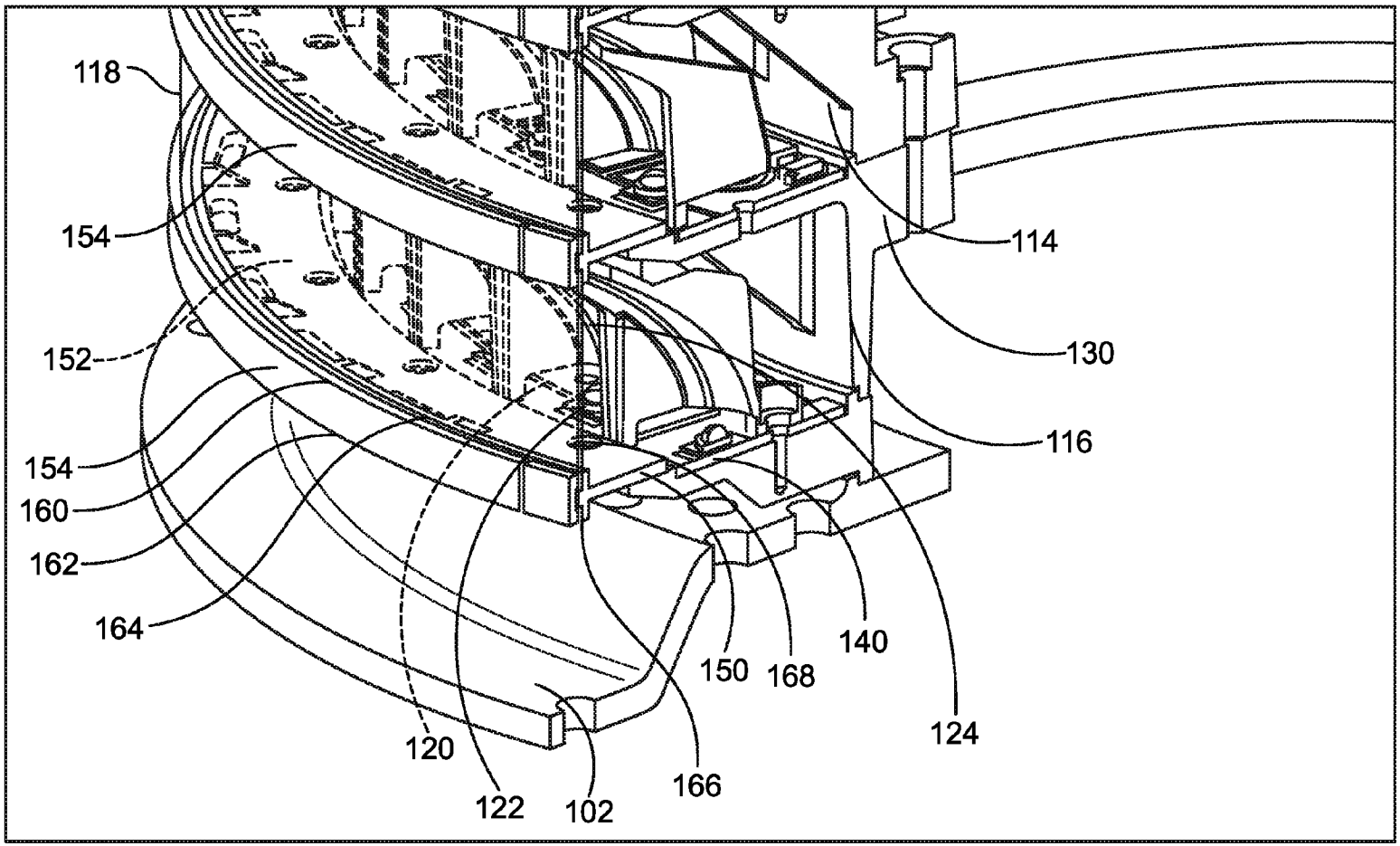
FIG. 5 is a close-up cross-section view of the concentric ring assembles of LEDs, reflectors, diffuser elements and circuit boards of the LED high intensity light in FIG. 1 the high intensity light of FIG. 1.

FIG. 2 shows a perspective view of the light engine 108 of the LED-based light 100 in FIG. 1 with the diffuser elements 118 in place. FIG. 3 shows a perspective view of the light engine 108 with the diffuser elements 118 removed for purposes of illustration. FIG. 4 is a cross-sectional view of the light engine 108. FIG. 5 is a close up cross-section view of the lighting ring assemblies 114 and 116. With reference to FIGS. 2-5, each of the lighting ring assemblies 110, 112, 114 and 116 has multiple optical elements 120 that emit light from the entire circumference of the lighting ring assembly 116 through the exterior diffuser elements 118. For example, the lighting ring assembly 116 supports and aligns the optical elements 120 around the entire circumference of the lighting ring assembly 116 as shown in FIGS. 1 and 2. Each of the optical elements 120 has an LED 122 and a reflector 124.

In this example, there are thirty-six (36) total optical elements 120 in the lighting ring assembly 116. The thirty-six (36) optical elements 120 arrayed around the lighting ring assembly 116 are arranged so that each optical element 120 (LED 122 and reflector 124) occupies 10 degrees of the circumference of the lighting ring assembly 116. Of course it is to be understood that different numbers of optical elements 120 may be used. Each reflector 124 is designed to form a horizontal (azimuth) beam approximately 5° to 10° wide at its half-maximum intensity. In this example, the reflectors 124 are constructed of molded plastic and coated with aluminum or other highly reflective material.

Each of the lighting ring assemblies 110, 112, 114 and 116 are offset from each other such that the optical elements 120 for each of the rings are offset from each other by 2.5 degrees. Light is generated by commercially available light emitting diodes (LEDs) 122. The LEDs 122 are generally "high-power" and emit white, red, or other color light as appropriate to the desired function of the high intensity light. The LEDs 122 may be affixed to printed circuit boards 140 as shown in FIG. 5, which provide electrical energy to the LEDs 122 and transfer heat by conduction from the LEDs 122 to the heat sink ring 130. In this example, the LED 122 is a high-brightness white LED such as an XLamp XREWHT 7090 XR series LED available from Cree. In this example, the printed circuit boards 140 each hold six LEDs and reflector pairs and therefore there are six printed circuit boards 140 for each of the concentric ring assemblies 110, 112, 114 and 116.

The lighting ring assembly 116 has a ring shaped heat sink 130. In this example, the ring shaped heat sink 130 is made of cast and machined aluminum or any other suitable material. The interior surface of the heat sink 130 has a series of upper tabs 132 and a series of lower tabs 134. As will be understood, the offset angle of the assemblies 110, 112, 114 and 116 from each other will be a function of the number of LEDs per ring and the number of rings per light engine. The particular offset angle of 2.5 degrees herein is for the exemplary case of 36 LEDs per ring assembly and the total of four ring assemblies 110, 112, 114 and 116.

Each of the lower tabs 134 has a series of alignment holes 136 extending therethrough. The angular spacing between each of the alignment holes 136 has been established so that by choosing one of these holes for alignment purposes. During manufacturing, offset angles may be created between adjacent rings that range from approximately 1.66 degrees to approximately 5.0 degrees. This allows use of the same ring components to assemble light engines with different numbers of LEDs and different numbers of rings. Bolts (not shown) are inserted through corresponding holes 136 in each of the lighting ring assemblies 110, 112, 114 and 116 to offset each ring from the adjacent ring by the desired offset angle. This results in each of the optical elements 120 in a lighting ring such as the ring assembly 116 to be offset from each of the optical elements 120 in the next lighting ring 114 by the desired offset, which is 2.5 radial degrees in this case.

FIG. 5 shows a close up cross-section perspective view of the lighting ring assemblies 114 and 116. The supporting semi-circular shaped circuit board 140 serves to support and align each of the six LEDs 122 and the reflectors 124 mounted on the board. The circuit board 140 transfers heat generated from the LEDs 122 to the heat sink ring 130. Heat is therefore removed from the LEDs 122 via conduction through the printed circuit board 140 and through the ring assemblies 110, 112, 114 and 116 to the base ring 102. Heat is transferred by conduction from the base ring 102 to the base housing 103 in FIG. 1 and then transferred by conduction to the mounting surface for the high intensity light 100 or transferred by convection to the ambient air.

The circuit board 140 provides direct electrical power to the LEDs 122 via power supplies (not shown) which may be installed in the middle of the ring assemblies 110, 112, 114 and 116. A master circuit board (not shown) having power and control circuits may be installed in the base housing 103. In this example, the supporting circuit board 140 is a thermally conductive printed circuit board (PCB), having a metal core of aluminum or copper. The LEDs 122 are preferably attached using solder, eutectic bonding, or thermally conductive adhesive. The supporting circuit board 140 has physical registration features that fix its radial position on the heat sink ring 130. The circuit boards 140 may be attached to the heat sink rings 130 by screws or other attachment means such as adhesive. Thermal conductive grease or other materials may be used to improve heat transfer from the circuit boards to the rings. The heat sink rings 130 serve to support and align the circuit boards 140, LEDs 122, primary reflectors 124, and diffuser elements 118.

Each of the ring assemblies 110, 112, 114 and 116 have optical diffuser elements 118 at a fixed location relative to the corresponding LEDs 122 and primary reflectors 124 of the respective optical elements 120. Each of the ring assemblies 110, 112, 114 and 116 include a circular holder 150 to hold the diffuser elements 118. The circular holder 150 includes a ring shaped base 152 coupled to a beam blocking wall 154. The beam blocking wall 154 is ring shaped having an upper surface 160 and a lower surface 162. The upper and lower surfaces 160 and 162 each have a circular tracked slot 164 and 166 running along the entire circumference of the beam blocking wall 154, respectively, that each hold the diffuser elements 118 between two circular holders 150. The ring shaped base 152 of the circular holders 150 also include a series of holes 168 for bolts to attach the circular holder 150 to the heat sink ring 130 of a respective lighting ring assembly.

Light from the LEDs 122 is collected by the primary reflectors 124 and redirected toward the diffuser element 118. The reflectors 124 may include contours intended to provide a specific beam pattern of light. The primary reflectors 124 may also each have different optical surfaces such that the summation of light from all reflectors has the desired beam pattern as described further in U.S. Provisional Application No. 60/174,785 filed on May 1, 2009, hereby incorporated by reference. Specifically, the beam pattern from each primary reflector 124 is designed to be narrow in elevation angle and wide in azimuth in this example. In this example, the reflectors 124 each form a horizontal beam approximately 5 to 10 degrees wide. Alternatively, all the primary reflectors 124 may be positioned or aimed in such a way as to direct reflected light to a particular elevation angle. Also, each primary reflector 124 may be positioned or aimed to provide beam symmetry relative to the horizon elevation angle. Each primary reflector 124 may also be positioned or aimed differently such that the summation of light from all reflectors 124 results in the desired beam pattern. The mechanisms to position each primary reflector 124 are further explained in U.S. Provisional Application No. 60/174,785 filed on May 1, 2009 hereby incorporated by reference.

The tracked slots 164 and 166 of the circular holders 150 support, align, and clamp the diffuser elements 118 in position to mix the light from the optical elements 120 on the concentric ring assemblies. In this example, the circular holders 150 are made of molded plastic and are attached to the heat sink rings 130 with screws that are attached through the holes 168 in the surface of the concentric base 152. Of course, other materials may be used for the circular holders 150. Alternately, the function and features of the circular holders may be incorporated into the heat sink rings 130.

The beam blocking wall 154 may be provided with a specific height to physically block light emitted from the optical elements 120 below a certain elevation angle, such as −10° in this example, in order to meet specific optical requirements. The beam blocking wall 154 may be a separate piece, or may be integrated into the diffusing element circular holder 150 as in the illustrated example, or may be incorporated into the heat sink ring 130.

The diffuser elements 118 in this example are a so-called "holographic" plastic film shaped into a cylinder by being mounted in the tracked slots 164 and 166 of the holders 150. These films have a microstructure which accept collimated or non-collimated incident light at one surface (facing the optical elements 120) and emits light from the second, exterior, surface over defined angles of azimuth and elevation relative to the surface. The diffusing pattern may be molded, embossed, ruled, or otherwise formed or created on one or both surfaces of the plastic film. The pattern, or microstructure, determines the angles of emission of light from the optical elements 120. In this example, the "holographic" plastic film of the diffuser element 118 has a wide (e.g., 10°-40°) azimuth emission angle and a relatively narrow (e.g., 1°-10°) elevation emission angle. The diffuser elements 118 may alternately be lenses such as Fresnel lenses which serve to preferentially spread the beam in the horizontal direction (azimuth) but not spread the light in the vertical direction (elevation). These lenses may be made of molded plastic or glass and may cover one or more optical elements and one or more ring assemblies. Rather than multiple diffuser elements 118, the diffuser elements may be one large cylindrical element that covers all of the light emissions from the ring assemblies 110, 112, 114 and 116, instead of individual elements for each individual ring assembly. Also, different diffusing elements may be used over various angles of azimuth to create a light beam which is not uniform over all angles of azimuth but rather has a directional nature if desired in the light design.

Figure 6:
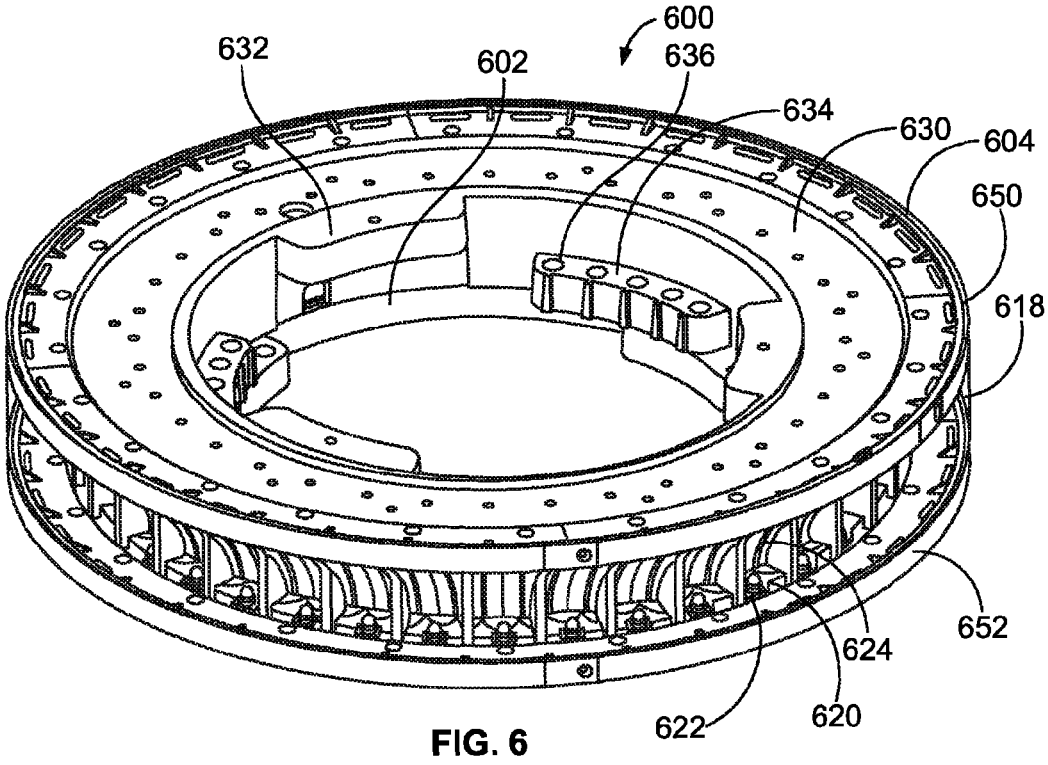
FIG. 6 is a perspective view of an alternative single concentric ring LED high intensity light with an exterior diffuser.
Figure 7:
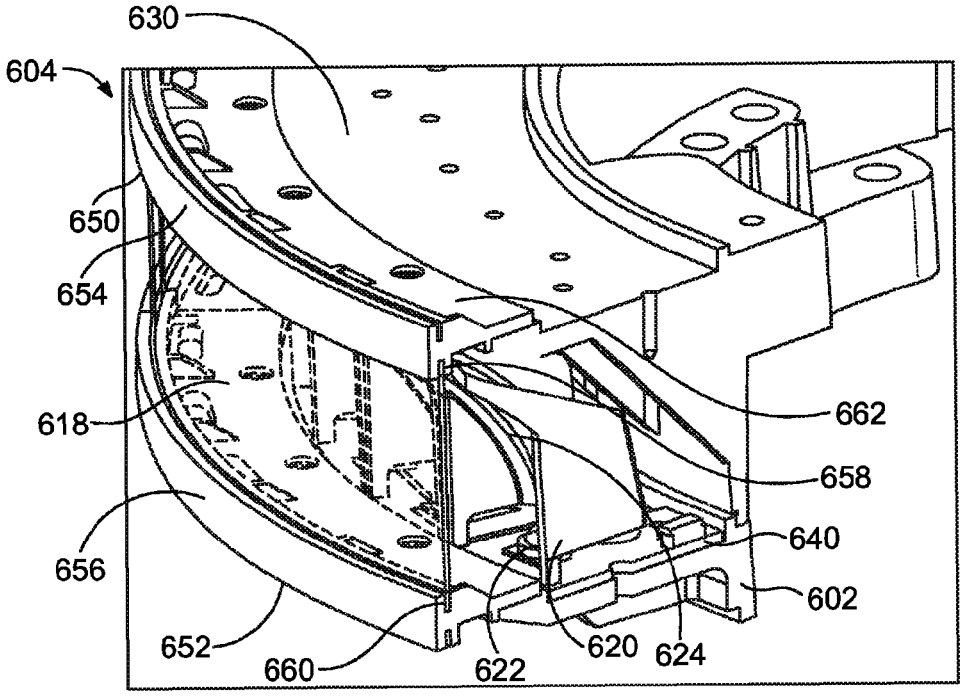
FIG. 7 is a cross-section view of the single concentric ring of the LED high intensity light in FIG. 6.

Another example is a light engine 600 for a 2,000 cd beacon as shown in FIG. 6 and FIG. 7. The light engine 600 has a generally cylindrical base member 602 that mounts a single ring 604. The light engine 600 mounts within an enclosure similar to that shown in FIG. 1 wherein a base housing contains wiring, power supplies, and controls for the optical elements of the lighting ring assembly 604. This example has elements and features similar to the 20,000 cd high intensity light 100 in FIGS. 1-5 but has a single ring assembly 604 rather than the four stacked ring assembly used for the 20,000 cd beacon in FIG. 2. The light engine 600 has thirty six optical elements 620 that each include a LED 622 and a primary reflector 624. As with the above example, the LEDs 622 may emit white or red light or other colored light. The light output of the optical elements 620 are emitted through a secondary diffuser element 618 that is spaced from the LEDs 622. The multiple optical elements 620 are mounted on a heat sink ring 630 and emit light from the entire circumference of the lighting ring assembly 604. The heat sink ring 630 has an interior surface with a series of upper tabs 632 and lower tabs 634. The lower tabs 634 include mounting holes 636 that allow the concentric ring 604 to be mounted on the base member 602.

The optical elements 620 are mounted on a series of six, semi-circular, circuit boards 640 that are fixed on the heat sink ring 630. In this example, six of the optical elements 620 are mounted on each supporting circuit board 640 for 36 total optical elements 620. The thirty-six (36) optical elements 620 arrayed around the concentric lighting ring assembly 604 are arranged so that each optical element 620 (LED 622 and reflector 624) occupies 10° of the circumference of the lighting ring assembly 604. Of course it is to be understood that different numbers of optical elements and circuit boards may be used.

The diffuser element 618 is mounted between two circular mounting rings 650 and 652 that have respective circular beam blocking walls 654 and 656. The beam blocking wall 654 of the upper mounting ring 650 has a lower slot 658 that holds the diffuser element 618 while the beam blocking wall 656 of the lower mounting ring 652 has an upper slot 660 that cooperate to hold the diffuser element 618 in place relative to the optical elements 620 as shown in FIG. 7. The upper mounting ring 650 includes a flat support base 662 that is fixed on the heat sink ring 630 to hold the mounting ring 650 in place. The mounting ring 652 is similarly held on the base member 602. Similar to the above example, the diffuser element 618 in this example is a "holographic" plastic film shaped in a cylinder. The diffuser element 618 has a microstructure which accepts collimated or non-collimated incident light at one surface facing the optical elements 620 and emits light from the second, exterior, surface over defined angles of azimuth and elevation relative to the surface. In this example, the "holographic" plastic film of the diffuser element 618 has a wide (e.g., 10°-40°) azimuth emission angle and a relatively narrow (e.g., 1°-10°) elevation emission angle.

As shown by the lights 100 and 600, any number of ring assemblies of optical elements, such as in the range one to twenty-five rings, may be used to achieve different photometric requirements. Since the light output from multiple rings is approximately additive, one could, for example, use 12 rings and/or higher power LEDs to construct a 100,000 cd beacon.

Figure 8A:
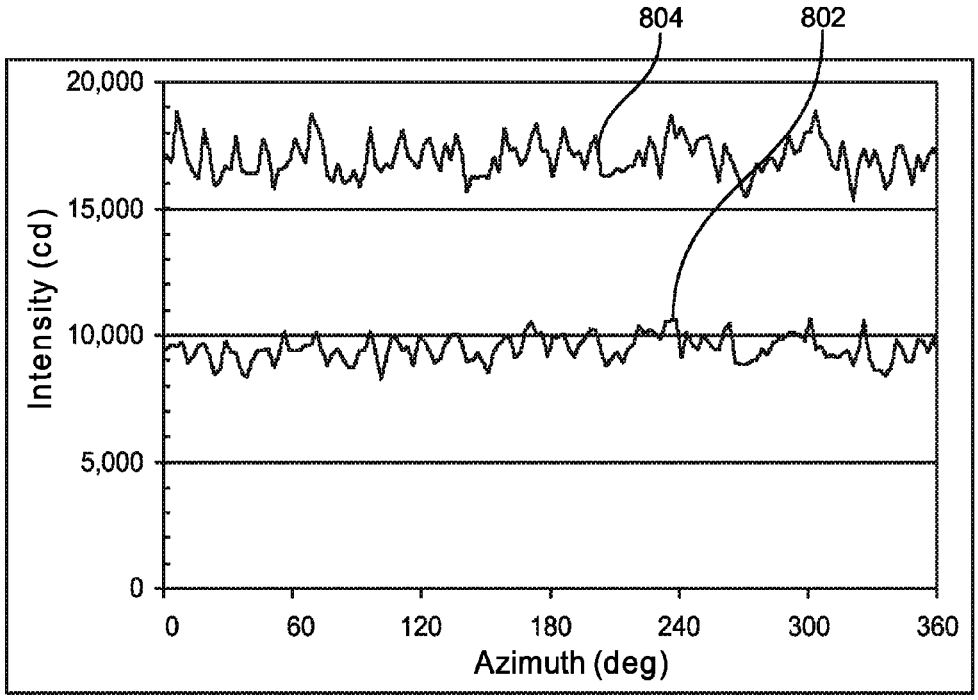
FIG. 8A is a graph showing the azimuth data for the high intensity light in FIG. 1 without diffuser elements.

For the light 100 in FIGS. 1-5 and the light 600 in FIGS. 6-7, the beam patterns from each primary reflector 124 (624) for the optical elements 120 (620) may differ due to different output intensity and emission pattern of each LED 122 (622), slight variations in reflector surface contour, and differences in the positional relationship between the LED 122 (622) and reflector 124 (624). Furthermore, the total light output from the high intensity light 100 or 600 is approximately a summation of the "overlapping" light from each LED 122 (622) and reflector 124 (624) of the optical elements 120 (620). FIG. 8A is a graph of beam intensity versus azimuth of the light 100 in FIG. 1 with the absence of the secondary diffuser element 118. A trace 802 shows the intensity versus azimuth at −1° elevation while a trace 804 shows the intensity versus azimuth at +1° elevation. As illustrated in FIG. 8A, this variation and summation causes the resulting total light intensity to exhibit peaks and valleys, termed "ripple" in both traces 802 and 804. The summation and ripple are primarily in the azimuthal direction. As discussed above, such ripple may make it difficult or even impossible for a beacon to satisfy stringent photometric requirements.

Figure 8B:
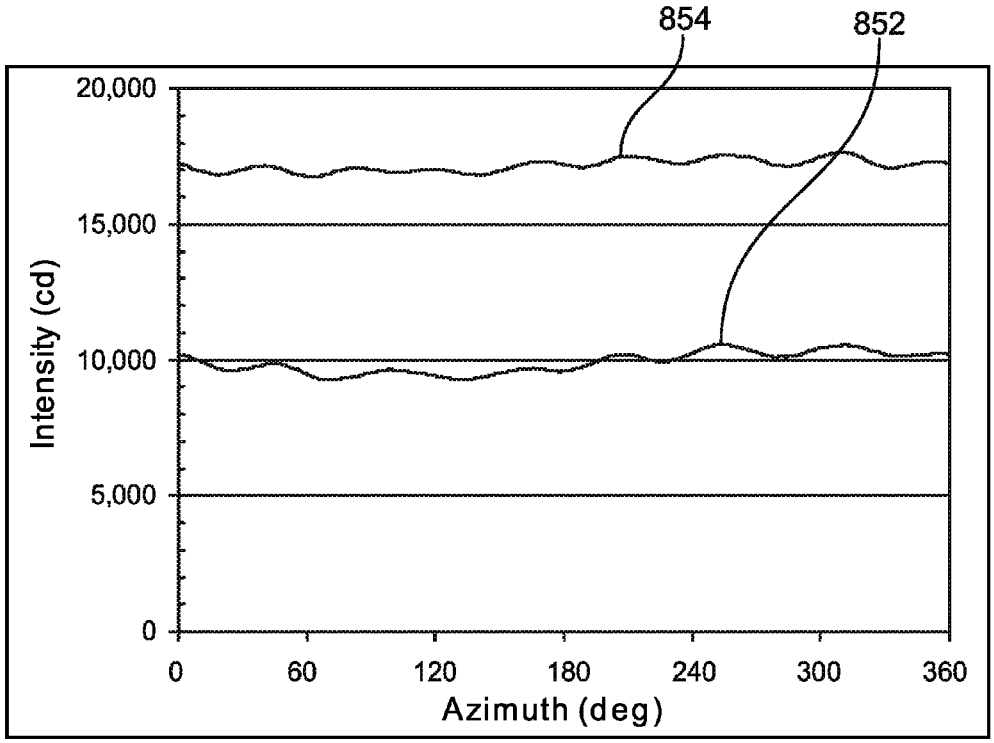
FIG. 8B is a graph showing the azimuth data for the high intensity light in FIG. 1 with the diffuser elements in place.

The addition of the secondary diffuser element 118 serves to horizontally spread and mix the light from the LED 122 and reflector 124 of each of the optical elements 120 in FIGS. 1-5. FIG. 8B is a graph of beam intensity versus azimuth of the emissions from the optical elements 120 in FIG. 8A with the secondary diffuser element 118 in place. A trace 852 shows the intensity versus azimuth at −1° elevation while a trace 854 shows the intensity versus azimuth at +1° elevation. As shown in FIG. 8B, the resulting summation of light that has passed through the diffuser elements 618 exhibits significantly reduced ripple in both traces 852 and 854, enabling the beacon to readily satisfy photometric requirements.

The secondary diffuser element 118 also creates a more uniform beam, particularly in azimuth, and therefore allows photometric specifications to be met more readily. FIG. 9A is a graph showing the intensity from 20,000 cd ICAO compliant light engine such as the high intensity light 100 in FIG. 1 without the diffuser element 118 versus elevation angle. A series of lines 902, 904 and 906 represent mean intensity values at different elevation angles. The middle line 902 shows the mean intensity values for each elevation angle over all angles of azimuth. The upper line 904 shows the maximum values and the lower line 906 represents the minimum intensity values. The difference between the maximum and the minimum values is a measure of beam uniformity at any elevation angle. Without the diffuser element 118 the maximum and minimum intensity curves 904 and 906 are at the extreme limits of the −1° window of allowable intensity.

Figure 9B:
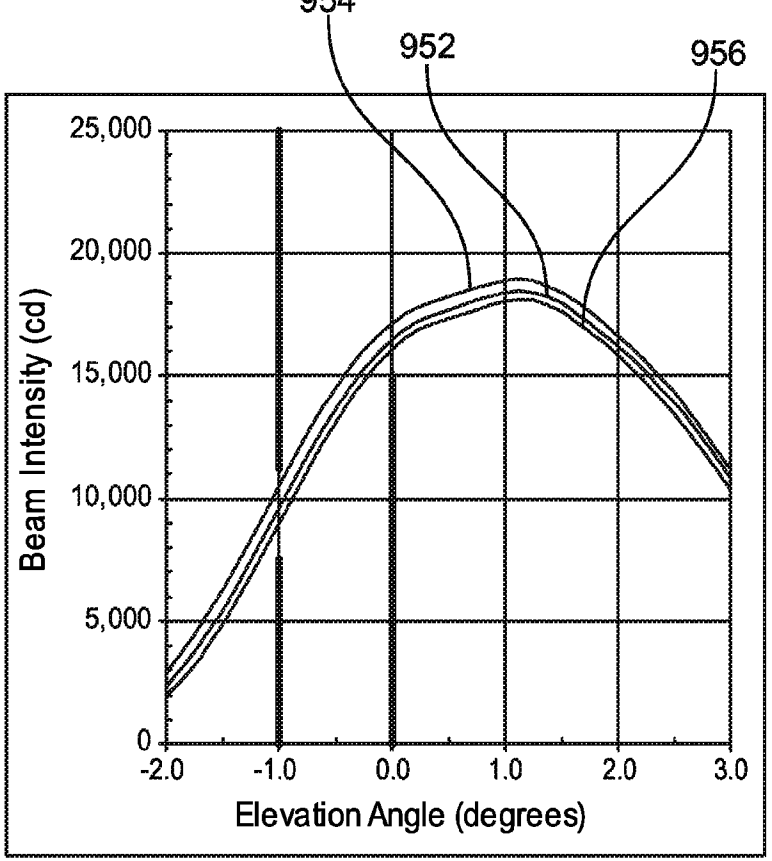
FIG. 9B is a graph showing the elevation data for the high intensity light in FIG. 1 with the diffuser elements in place.
Figure 9A:
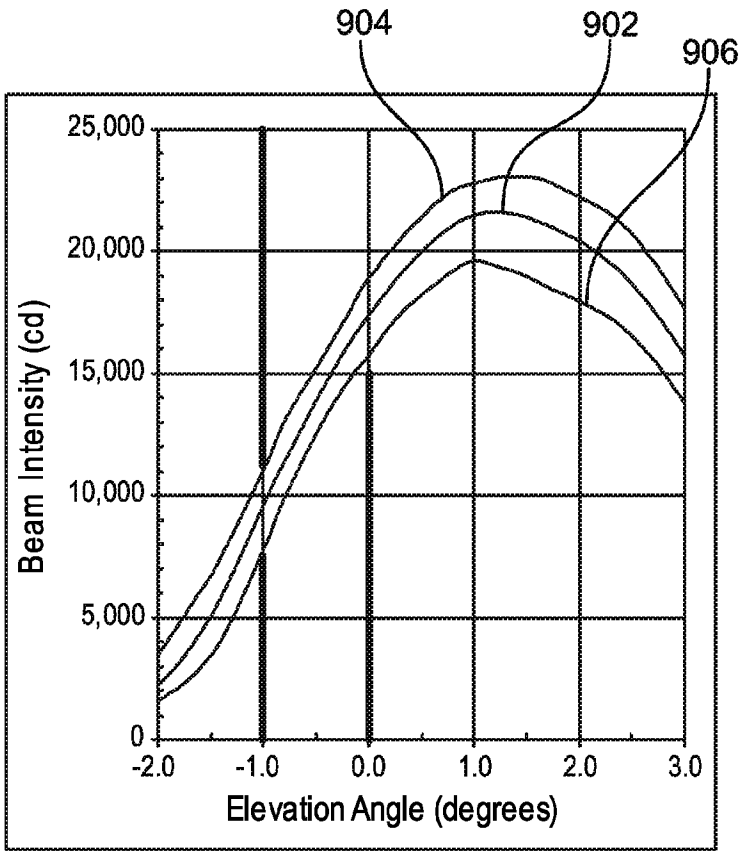
FIG. 9A is a graph showing the elevation data for the high intensity light in FIG. 1 without diffuser elements.

FIG. 9B is a similar elevation graph with a light engine such as the high intensity light 100 in FIG. 1 that has the diffuser element 118 in place. The graph in FIG. 9B includes three lines 952, 954 and 956 that represent mean intensity values. As a result of the diffuser element 118, the distance between maximum and minimum intensity curves 954 and 956 readily falls within the limits of the −1° window of allowable intensity.

The secondary diffuser design makes it possible to meet different beam pattern specifications using differing or varying combinations of LEDs, primary reflectors, primary reflector placement and diffuser elements with different diffusing patterns. For example, the 2,000 candela red ICAO specification can be met with a single row of red LEDs with primary reflectors 624 and secondary diffusing elements 618, as shown in the light engine 600 of FIGS. 6-7. Other lights meeting different product specifications are possible, such as the German specification, the UK specification, or the 2,000 cd red light FAA specification. The physical implementation for each may be similar to that of the light engine 600 in FIGS. 6-7 with varying positions (aim) of the primary reflectors 624 and by using diffusing elements 618 with different diffusion patterns.

The concepts and inventive matter described herein are not limited to beacon lights or obstruction lamps but may be applied to any illumination source requiring precise control of illuminating beam pattern. Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A light engine for a high intensity light comprising:

a first ring assembly having a first plurality of reflectors and light emitting diodes, the ring assembly having a planar surface mounting each of the plurality of reflectors in positional relation to a respective one of the plurality of light emitting diodes; and a diffuser interposed around the first concentric ring assembly to mix light from at least some of the plurality reflectors and light emitting diodes.

2. The light engine of claim 1, further comprising a circular mounting device holding the diffuser.

3. The light engine of claim 2, wherein the mounting device has a circular beam blocking wall to prevent stray light from the light emitting diodes being emitted below a predetermined elevation angle.

4. The light engine of claim 1, further comprising a second, third and fourth concentric ring assembly mounted on the first ring assembly, each of the second, third and fourth ring assemblies having a plurality of reflectors and light emitting diodes and a diffuser element.

5. The light engine of claim 1, wherein the light engine is associated with a high intensity light designed to be compliant with FAA and ICAO standards for 20,000 cd lights or 2,000 cd lights.

6. The light engine of claim 1, wherein the first ring assembly includes a plurality of circuit boards mounting the light emitting diodes and a heat sink coupled to the plurality of circuit boards.

7. The light engine of claim 1, wherein the reflectors each form a horizontal beam approximately 5 to 10 degrees wide.

8. The light engine of claim 1, where the diffuser is used to reduce azimuth ripple from the light emitted by at least some of the plurality of light emitting diodes and reflectors.

9. The light engine of claim 1, wherein the diffuser is a Fresnel lens spreading the beams from the light emitting diodes in a horizontal direction but not in a vertical direction.

10. The light engine of claim 1, wherein the diffuser is a holographic plastic film having a diffusing pattern.

11. The light engine of claim 1, wherein the light emitting diodes emit either red or white light.

12. A high intensity light beacon designed to be compliant with FAA and ICAO standards, the light beacon comprising:

a first ring assembly having a first plurality of primary reflectors and light emitting diodes, the ring assembly having a planar surface mounting a first diffuser positioned in relation to the first plurality of primary reflectors and light emitting diodes, the first diffuser mixing the light from the first plurality of primary reflectors and light emitting diodes;

a second ring assembly mounted on the first ring assembly, the second ring assembly having a second plurality of primary reflectors and light emitting diodes, the second ring assembly having a planar surface mounting a second diffuser positioned in relation to the second plurality of primary reflectors and light emitting diodes, the second diffuser mixing the light from the second plurality of primary reflectors and light emitting diodes;

a third ring assembly mounted on the second ring assembly, the third ring having a third plurality of reflectors and light emitting diodes, the third ring assembly having a planar surface mounting a third diffuser positioned in relation to the third plurality of primary reflectors and light emitting diodes, the third diffuser mixing the light from the third plurality of primary reflectors and light emitting diodes; and a fourth ring assembly mounted on the third ring assembly, the fourth ring assembly having a fourth plurality of reflectors and light emitting diodes, the fourth ring assembly having a planar surface mounting a fourth diffuser positioned in relation to the fourth plurality of primary reflectors and light emitting diodes, the fourth diffuser mixing the light from the fourth plurality of primary reflectors and light emitting diodes.

13. The light beacon of claim 12, wherein the first ring assembly includes a circular mounting device holding the first diffuser.

14. The light beacon of claim 12, wherein the mounting device has a circular beam blocking wall to prevent stray light from the light emitting diodes of the first ring assembly being emitted below a predetermined elevation angle.

15. The light beacon of claim 12, wherein the reflectors of the first and second ring are offset from each other.

16. The light beacon of claim 12, wherein the first ring assembly includes a plurality of circuit boards mounting the light emitting diodes and a heat sink coupled to the plurality of circuit boards.

17. The light beacon of claim 12, wherein the pluralities of primary reflectors each form a horizontal beam approximately 5 to 10 degrees wide.

18. The light beacon of claim 12, where the diffusers are used to reduce azimuth ripple from the light emitted by at least some of the plurality of light emitting diodes and reflectors.

19. The light beacon of claim 12, wherein the diffusers are a Fresnel lens spreading the beams from the light emitting diodes in a horizontal direction but not in a vertical direction.

20. The light beacon of claim 12, wherein the diffusers are a holographic plastic film having a diffusing pattern.

* * * * *